US011939091B2

(12) United States Patent
Davila et al.

(10) Patent No.: US 11,939,091 B2
(45) **Date of Patent: *Mar. 26, 2024**

(54) INSULATING PACKAGE

(71) Applicant: KNAUF INSULATION SPRL, Vise' (BE)

(72) Inventors: Eva Davila, Mont-Saint-Guibert (BE); Cedric Mommer, Mont-Saint-Guibert (BE)

(73) Assignee: Knauf Insulation SPRL, Vise (BE)

( * ) Notice: Subject to any disclaimer, the term of this patent is extended or adjusted under 35 U.S.C. 154(b) by 1106 days.

This patent is subject to a terminal disclaimer.

(21) Appl. No.: 16/260,888

(22) Filed: Jan. 29, 2019

(65) Prior Publication Data

US 2020/0239169 A1 Jul. 30, 2020

Related U.S. Application Data

(63) Continuation of application No. 15/324,707, filed as application No. PCT/EP2015/065632 on Jul. 8, 2015, now Pat. No. 10,427,848.

(30) Foreign Application Priority Data

Jul. 11, 2014 (GB) ..... 1412350

(51) Int. Cl.

| | |
|---|---|
| ***B65B 1/24*** | (2006.01) |
| ***B65B 27/12*** | (2006.01) |
| ***B65B 63/02*** | (2006.01) |
| ***E04B 1/74*** | (2006.01) |

(52) U.S. Cl.

CPC ..... *B65B 27/125* (2013.01); *B65B 1/24* (2013.01); *B65B 63/02* (2013.01); *E04B 1/74* (2013.01); *E04B 2001/743* (2013.01)

(58) Field of Classification Search

CPC ..... B65B 27/12; B65B 27/125; B65B 1/24; B65B 63/00; B65B 63/022; B65B 63/026; B65B 63/028; B65B 63/05

See application file for complete search history.

(56) References Cited

U.S. PATENT DOCUMENTS

| | | | | |
|---|---|---|---|---|
| 4,535,587 A | | 8/1985 | Rias | |
| 4,592,193 A | | 6/1986 | Gustavsson | |
| 4,909,817 A | * | 3/1990 | Gill | D04H 1/4209 65/438 |

(Continued)

FOREIGN PATENT DOCUMENTS

| | | |
|---|---|---|
| EP | 0150687 A2 | 8/1985 |
| EP | 1321382 A1 | 6/2003 |

(Continued)

OTHER PUBLICATIONS

International Search Report and Written Opinion of International Searching Authority for PCT/EP2015/065632 (10 pages), completed Sep. 3, 2015.

(Continued)

*Primary Examiner* — Chelsea E Stinson

(74) *Attorney, Agent, or Firm* — Knauf Insulation, Inc.; James K. Blodgett

(57) ABSTRACT

The present application relates to a method for manufacturing an improved package of compressed mineral wool insulation blowing wool fibers.

18 Claims, 7 Drawing Sheets

(56) References Cited

U.S. PATENT DOCUMENTS

| | | | | |
|---|---|---|---|---|
| 5,213,030 | A | 5/1993 | Bolstad | |
| 5,350,063 | A | 9/1994 | Berdan | |
| 5,459,982 | A * | 10/1995 | Long | B30B 9/3014 53/529 |
| 6,708,465 | B1 * | 3/2004 | Gustafsson | B65B 51/20 53/529 |
| 7,823,368 | B2 * | 11/2010 | Hansen | B65B 63/02 53/529 |
| 7,913,842 | B2 * | 3/2011 | Evans | B65D 75/5827 206/83.5 |
| 10,427,848 | B2 * | 10/2019 | Davila | B65B 27/12 |
| 2007/0277479 | A1 | 12/2007 | Hansen et al. | |
| 2010/0146908 | A1 | 6/2010 | Honegger | |
| 2011/0162991 | A1 | 7/2011 | Albrecht et al. | |

FOREIGN PATENT DOCUMENTS

| | | | |
|---|---|---|---|
| EP | 1777170 | A1 | 4/2007 |
| EP | 1914344 | A1 | 4/2008 |
| GB | 1212415 | | 11/1970 |
| JP | 2007238184 | | 9/2007 |
| WO | 0216223 | A1 | 2/2002 |

OTHER PUBLICATIONS

Office action for co-pending U.S. Appl. No. 15/324,707 (7 pages)—dated May 24, 2018.

* cited by examiner

INSULATING PACKAGE

CROSS-REFERENCE TO RELATED APPLICATIONS

This application is a continuation of U.S. application Ser. No. 15/324,707, filed Jan. 7, 2017, which is a U.S. national counterpart application of International Application Serial No. PCT/EP2015/065632, filed Jul. 8, 2015, under 35 U.S.C. § 371, which claims priority to GB Application Ser. No. 1412350.9, filed Jul. 11, 2014, the disclosures of which are hereby incorporated herein by reference.

SUMMARY OF THE INVENTION

This invention relates to a package of compressed mineral wool insulation blowing wool fibres, a method for manufacturing such a package and a method of filling a blowing machine using such a package.

Glass blowing wool fibres are generally retained by a plastics envelope under compression in a package having a mass of about 15.5 kg and dimensions of about 120 cm×55 cm×25 cm. During opening of the package, due to release of the compression, the blowing wool fibres tend to be released in all directions leading to spillage of the fibres. In addition, the sides of the package tend to be curved rather than planar due to the compression of the blowing wool and flexibility of the plastics packaging material; this makes it more difficult to stack packages for efficient transportation, for example by truck. Furthermore, the dimensions of the packages which are intended to allow manual handling are not suited to efficient arrangement on standard pallets.

One aim of the present invention is to provide an improved form of packaged mineral fibre blowing wool.

In accordance with one of its aspects, the present invention provides a package of mineral wool insulation blowing wool fibres as defined in claim 1. Additional aspects of the invention are defined in independent claims. The dependent claims define preferred and/or alternative embodiments.

When the package is opened, notably by releasing its retainer(s), the expansion of the blowing wool fibres along substantially a single expansion axis, notably a vertical axis, provides a system in which the blowing wool does not overflow beyond the footprint of its package. Consequently, the package may be opened, moved once opened and/or loaded once opened into a feeder of a blowing machine without any significant spillage of the blowing wool. This is particularly advantageous when the package of blowing wool is adapted to be used in an automated feeder system, notably a feeder system adapted to accept large or pallet sized packages of blowing wool. The package of blowing wool may be used to fill a hopper of a blowing machine, notably using an automated feeder system.

The expansion axis is preferably the vertical axis. This allows the upper surface of the package to be opened without any significant overflowing of the blowing wool.

By "substantially a single expansion axis", we mean that, in a (x,y,z) configuration, where the major expansion of the mineral wool insulation blowing wool fibres is in the z axis (i.e. the z axis is the expansion axis), although some expansions along the x axis and/or y axis may also occur any expansion along the x and/or y axis is not significant and is notably no more that 10% of the expansion along the z axis. For example, the expansion along the expansion axis between a retained configuration (in which the package is held under compression) and a released configuration (once the retainer(s) has been removed) may be:

≥20 cm, ≥30 cm, ≥35 cm, ≥50 cm, ≥75 cm, or ≥100 cm; and/or

≥20%, ≥30%, ≥35%, ≥50%, ≥75%, or ≥100% with respect to the package's dimension along the expansion axis in its retained configuration; and/or ≤200 cm, ≤150 cm, ≤80 cm, or ≤60 cm; and/or ≤200%, ≤150%, ≤120%, ≤100%, ≤80%, or ≤60% with respect to the package's dimension along the expansion axis in its retained configuration.

The term expansion refers to the change in dimension; where the expansion axis is vertical the expansion along this axis is preferably measured at the central position of the upper surface of the package, for example when the package is supported on a horizontal surface or pallet.

Expansion along each axis other than the expansion axis may be:

≥0.5 mm, notably ≥1 mm; and/or

≥0.05%, notably ≥0.1% with respect to the package's dimension along the expansion axis in its retained configuration; and/or ≤30 mm, notably ≤20 mm, or ≤15 mm or ≤10 mm; and/or ≤5%, notably ≤3% or ≤2% with respect to the package's dimension along the expansion axis in its retained configuration.

The end surfaces and/or the side surfaces of the package in its retained and/or released configuration may be substantially planar. This facilitates efficient transport of retained packages and/or loading of released packages in to a feeder system. In this context, substantially planar means that the maximum gap under a straight rule placed against the surface is ≤30 mm, preferably ≤20 mm.

The retainer may comprise one or more securing strap(s), for example three, four, five or more securing straps, notably of plastics or metal, arranged around the package. Each securing strap may have a width which is ≥8 mm, notably ≥12 mm and/or ≤25 mm. Alternatively, wire securing straps may be used, notably each securing strap comprising a wire having a diameter which is ≥0.5 mm and/or ≤4 mm Preferably each securing straps passes over the side surfaces and the upper and lower surfaces of the package leaving the end surfaces free from securing straps. This facilitates placing and removal of the securing straps.

The package may also comprise an enveloping film, notably comprising a plastics material. The envelope may comprise at least two portions, preferably three portions, notably an upper portion, a middle portion and a lower portion. In a preferred embodiment the upper portion covers the upper surface of the package and an upper part of the four lateral surfaces, the lower portion covers the lower surface and a lower part of the four lateral surfaces and the middle portion covers the four lateral surfaces and overlaps the upper portion and/or the lower portion. This facilitates free expansion of the mineral wool with little or no constraint from the enveloping film and/or removal of the enveloping film.

The mineral wool insulating blowing wool fibres may comprise or consist of glass fibres, rock fibres, slag wool fibres, virgin fibres, white wool fibres, binderless fibres, flocks, recycled fibres (notably recycled fibres from cured, binder containing mineral wool) or combinations thereof. Preferably, the blowing wool fibres are glass wool fibres. The fibres may be loose fibres and/or flocks; preferably they do not comprise a binder, notably an organic binder.

Where the fibres are glass wool fibres their composition may comprise: $SiO_2$ 55-75% wt; $Na_2O+K_2O$ 10-20% wt;

CaO 5-15% wt; CaO+MgO 5-20% wt; Al2O3 0.5-8% wt; Fe2O3 (total iron) 0-5% wt, B2O3 0-10 wt %, notably 1-6 wt %.

Compression of the mineral wool insulation blowing wool fibres within the package reduces the size of the package and facilitates transportation. The level of compression, and thus the density of the retained package, is selected to optimise reduced volume whilst avoiding damage to the fibres and providing suitable properties of the fibres upon release.

The package may be six-sided package, comprising an upper surface, a lower surface and four lateral surfaces (including two side surfaces and two end surfaces) notably a cube and/or substantially a rectangular parallelepiped. The dimensions of the package, in its retained configuration may comprise: a length which is ≥0.9 m or ≥1 m or ≥1.15 m and/or ≤1.5 m or ≤1.4 m; and/or a width which is ≥0.75 m or ≥0.9 m and/or ≤1.2 m or ≤1 m; and/or a height which is ≥0.8 m or ≥0.9 m or ≥0.95 m and/or ≤1.5 m or ≤1.2 m. Such dimensions are particularly suitable for arranging the package on a pallet; these dimensions also reduce the amount of packaging film used compared with known smaller packages of blowing wool. Furthermore, such dimensions are also particularly suitable for loading in to a blowing wool bale condition system for feeding a blowing machine. In one preferred embodiment the width of the package is about 0.8 m and its length is about 1.2 m; in another preferred embodiment the width is about 1 m and the length is about 1.2 m.

The package comprising mineral wool insulating blowing wool fibres may, notably when full or in its retained configuration, have a mass of at least 130 kg, at least 150 kg, at least 160 kg, at least 170 kg or at least 180 kg; it may have a mass of no more than 250 kg or no more than 200 kg.

Manufacture of the package may comprise compressing blowing wool fibres along a single axis, notably a vertical axis, to produce a compressed bulk of blowing wool fibres. The at least one retainer may be arranged around the package prior to release of pressure, for example by passing one of more securing straps through openings in a pressure retaining plate and around the package.

An embodiment of the invention will now be described, by way of example only, with reference to the accompanying drawings of which:

FIG. 1 is a perspective view of a package in a retained configuration;

FIG. 2 a perspective view of a package in a released configuration;

Figure 1:
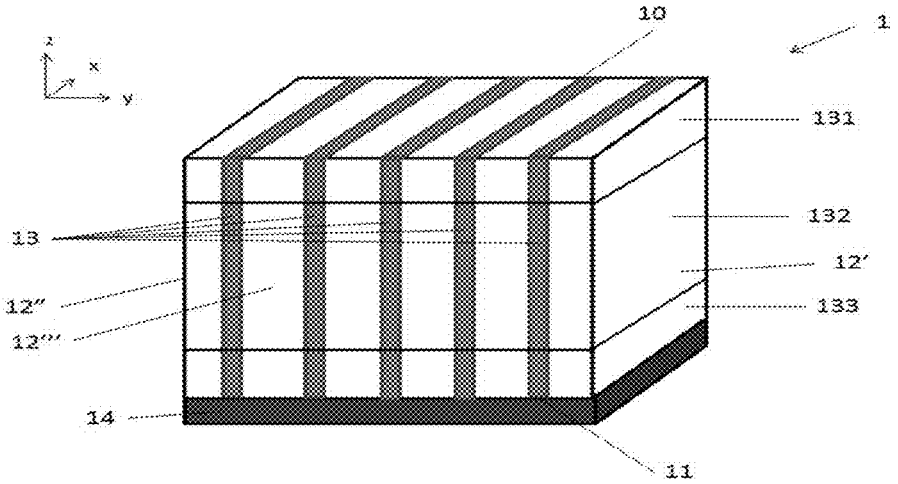

The compressed package of glass blowing wool of FIG. 1 is a six-sided package (1) comprising an upper surface (10), a lower surface (11) and four lateral surfaces which are two end surfaces (12', 12") and two side surfaces (12''') (only one side surface is visible in FIG. 1). The package (1) in its retained configuration is substantially a rectangular parallelepiped, having a length of about 1 m, a width of about 0.8 m and a height of about 1 m. The blowing wool fibers are loose, binderless glass wool fibers having an average diameter in the range 3.5 μm to 6.5 μm preferably manufactured by an internal spinning process.

The package (1) has a density of about 150 kg/m$^3$ and a mass of about 145 kg; it is supported by a pallet (14).

The package (1) is enveloped by three portions of a plastics enveloping film (131, 132, 133). The upper portion (131) of the enveloping plastic film covers the upper surface (10) and about 15 cm of the upper part of the four lateral surfaces (12', 12", 12'''). The lower portion (133) of the enveloping film covers the lower surface (11) and of about 15 cm of the lower part of the four lateral surfaces (12', 12", 12'''). The middle portion (132) of the enveloping film covers the four lateral surfaces (12', 12", 12''') and overlaps about 5 cm of the upper portion (131) and about 5 cm of the lower portion (133) of the enveloping film.

The package (1) also comprises retainers in the form of five plastics securing straps (13) arranged around the package (1) over the enveloping film and passing over the upper surface (10), the lower surface (11) and the two side surfaces (12'''). The securing straps (13) tightly secure the package and maintain it under compression; they may produce some deformation and/or non-planarity of the upper, lower and side surface (not shown). The end surfaces (12', 12") are free of retaining straps and are planar.

Figure 2:
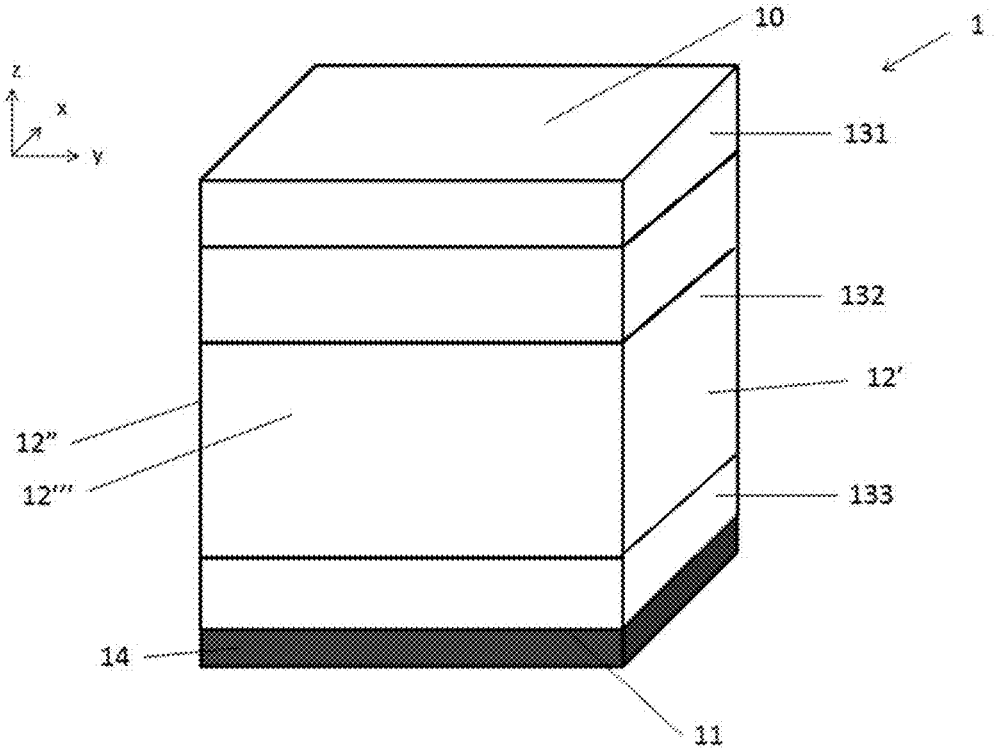

The securing straps may be cut using scissors in order to be removed from the package. When thus released, the package expands uniquely along its vertical expansion axis (z) from its retained configuration (shown in FIG. 1) to its released configuration (shown in FIG. 2). In its released configuration the four lateral surfaces (12) are substantially planar. Release of the retainers causes the height of the package to increase as the compression in the packaged blowing wool is released but as the expansion is only along the vertical axis (z) none of the loose blowing wool spills over beyond the package's footprint.

Figure 3:
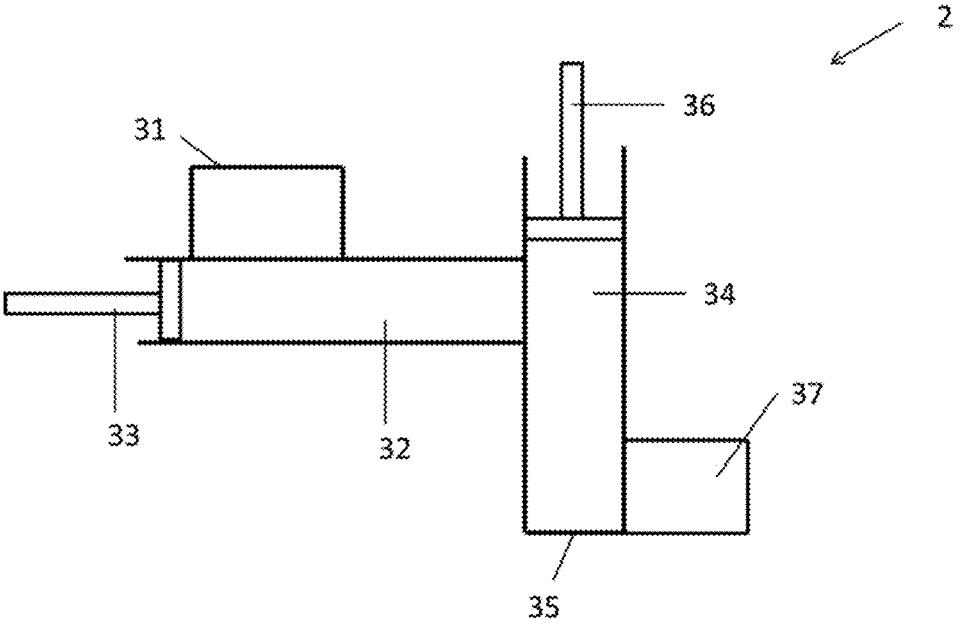
FIG. 3 is a schematic cross section of a machine for manufacturing a package.

The blowing wool package is manufactured by a baler (2) illustrated in FIG. 3. A desired mass of loose blowing wool (not shown) collected in a weighing hopper (31) is discharged in to a rectangular section loading zone (32). A loading piston (33) pushes the weighed blowing wool horizontally along the loading zone (32) in to a compression zone (34) having the lower portion (133) of an enveloping film (not shown) pre-positioned at a base 35. The upper portion (131) of the enveloping film (not shown) is positioned between an upper surface of the blowing wool and a compression piston (36) which compresses the mineral wool along a vertical axis. The compressed bulk of blowing wool fibres is then transferred, whilst being maintained under compression, from the compression zone to a packaging and strapping unit (37) at which the middle portion (132) of the enveloping plastic film is arranged around the four lateral surfaces (12) and the retaining straps (13) are secured. When removed from the packaging and strapping unit (37) and arranged on a pallet the retaining straps maintain the package under compression.

Figure 4:
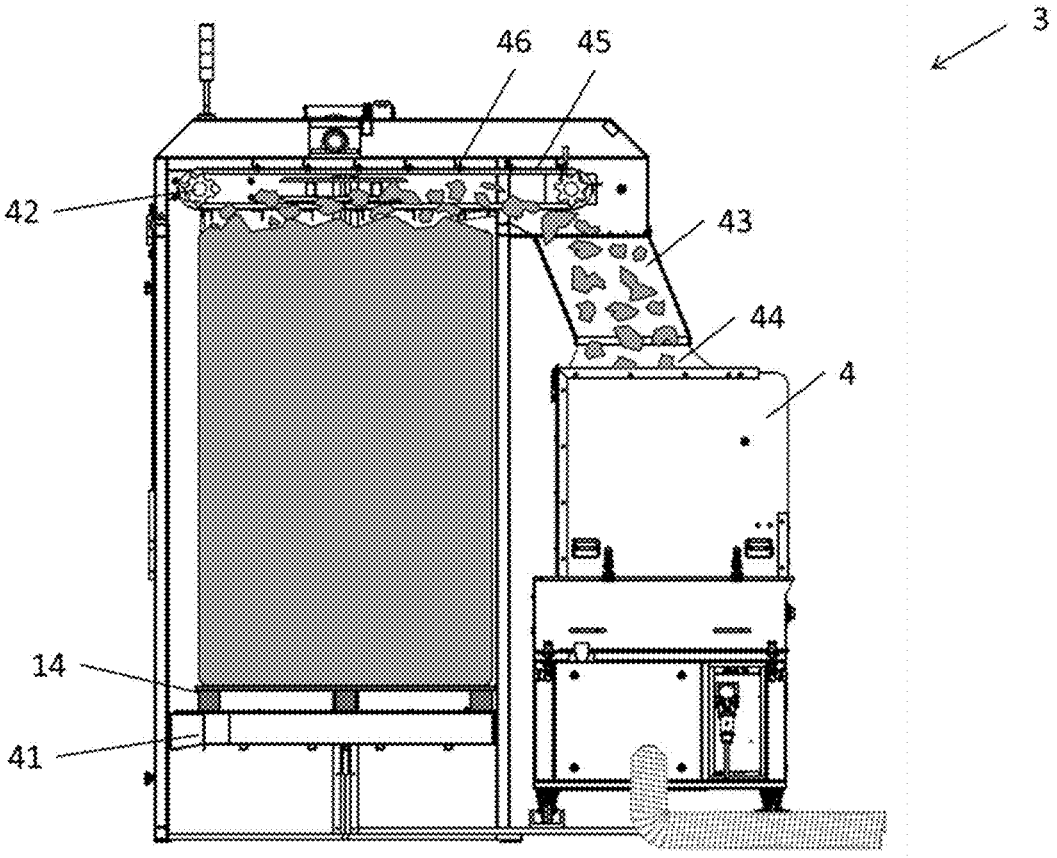
FIG. 4 is a schematic cross section of a bale conditioning system.

The package (1) is a stable, self-standing machine loadable package particularly suited for transport to and loading in to a blowing machine (4), as illustrated by FIG. 4. The blowing machine may be used to introduce blowing wool in to cavities of pre-fabricated building walls during their manufacture or in to cavities of metal building panels.

Once transported to the location of the blowing machine (4) the retainers (13) are removed from the package (1) and the blowing wool fibres expand along the vertical axis but without overflowing beyond the footprint of the package. The upper portion (131) and central portion (132) of the enveloping plastics film is then removed in order to provide a package loadable into a bale conditioning system (3) which comprises:

an elevator (41) on which the package (1) on the pallet (14) is placed;

a fibre unloader (42) at a upper portion of the bale conditioning system; and an outlet (43) leading to an inlet feeder (44) of a blowing machine (4).

The fibre unloader (42) comprises a belt (45) or alternatively a moving, rotating or reciprocating bar which, during raising of the package on the elevator, causes claws (46) to collect fibres from an upper surface of the package and deposit then in the outlet (43) from where they are fed to the inlet of the feeder (44) of the blowing machine. The raising of the package on the elevator and the displacement of the fibres from the upper surface of the package to the inlet of the blowing machine may be continuous or sequential.

The lower portion (133) of the enveloping plastics film may be secured to the pallet, for example by staples, to avoid any risk of it being detached and fed to the blowing machine.

Figure 5:
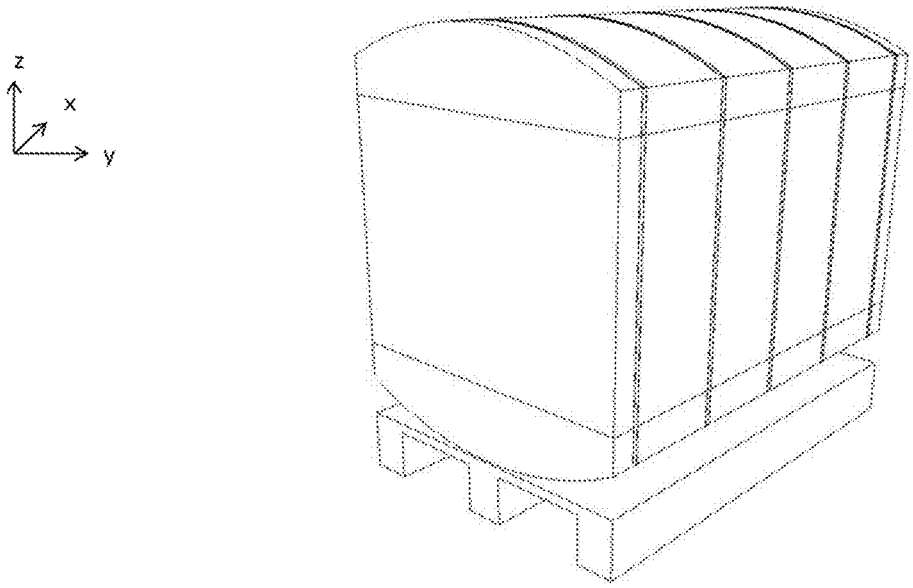
FIG. 5 is a perspective view of a package in a retained configuration.
Figure 6:
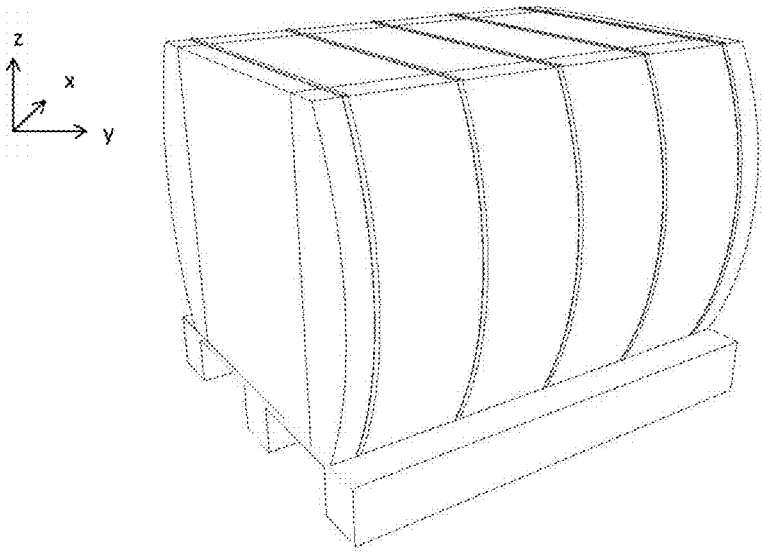
FIG. 6 is a perspective view of the package of FIG. 5 in a retained configuration positioned for transportation.
Figure 7:
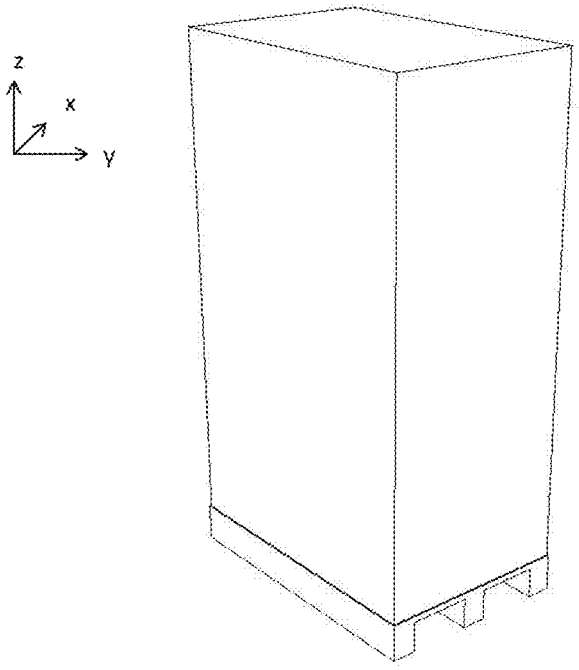
FIG. 7 is a perspective view of the package of FIG. 5 in a released configuration.

FIG. 5 also shows a package in a retained configuration, the curvature of the upper and lower surfaces being exaggerated. FIG. 6 shows the package of FIG. 5 which has been pivoted and laid on one of its lateral surfaces on a pallet so as to take advantage of the planarity of the side surface for additional stability for transportation. Such a configuration may also facilitate stacking a package or pallet on top for transport and/or storage. FIG. 7 shows the package of FIG. 6 in a released configuration after having been pivoted back to its initial position and after removal of the securing straps.

Figure 8:
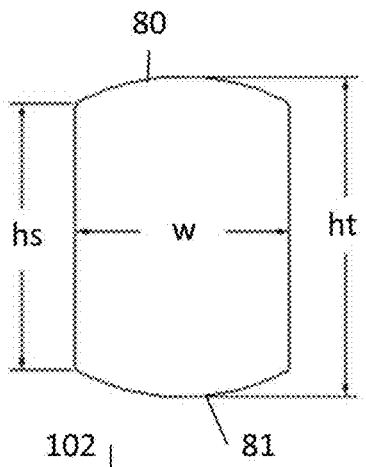
FIG. 8 is an end view of an alternative package in a retained configuration.
Figure 9:
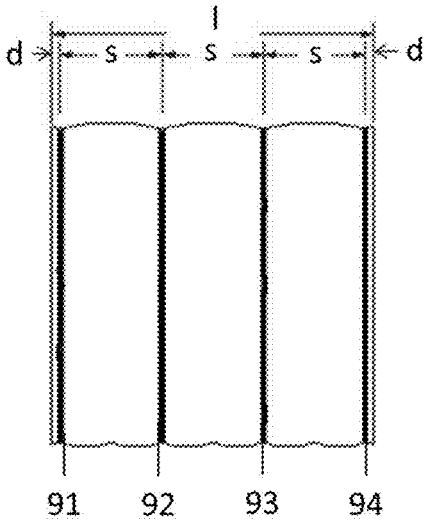
FIG. 9 is a side view of the package of FIG. 8.
Figure 10:
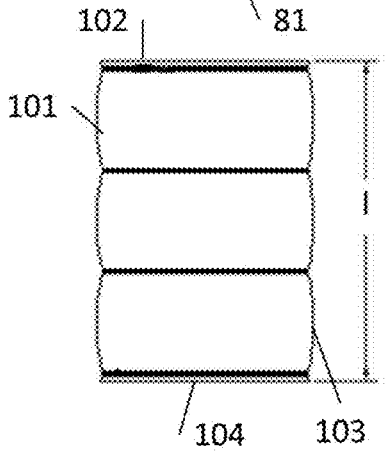
FIG. 10 is a top view on the package of FIG. 8.

The package illustrated in FIG. 8, FIG. 9 and FIG. 10 has a width w of 80 cm, a total height ht of 120 cm, a side height hs of 100 cm and a length 1 of 120 cm. Four retaining straps (91, 92, 93, 94) encircle the top, bottom, front and rear surfaces to retain the blowing wool contained within the package. The first (91) and fourth (94) retaining straps are positioned at a distance d of between 3 and 7 cm from their adjacent end faces. The spacing s between each adjacent strap is substantially the same, for example about 380 cm.

The package is enveloped by three portions of a plastics enveloping film (not shown). An upper portion of the enveloping plastic film covers an upper surface (80) and about 25 cm of the upper part of the four lateral surfaces (101, 102, 103, 104). A lower portion of the enveloping film covers a lower surface (81) and of about 25 cm of the lower part of the four lateral surfaces (101, 102, 103, 104). A middle portion of the enveloping film covers the four lateral surfaces (101, 102, 103, 104) and overlaps about 25 cm of the upper portion and about 25 cm of the lower portion (133) of the enveloping film.

What is claimed is:

1. A method for manufacturing a package of compressed mineral wool insulation loose blowing wool fibres comprising sequentially:

compressing uncompressed mineral wool insulation blowing wool fibres with a press along a single axis to produce a compressed bulk of blowing wool fibres; and retaining the compressed bulk of blowing wool fibres with at least one retainer, wherein the mineral wool insulation blowing wool fibres are selected from loose blowing wool fibres, loose blowing wool flocks and combination thereof, and wherein the retainer comprises one or more securing straps arranged around the package.

2. The method of claim 1, wherein the compressed bulk of blowing wool fibres is configured to expand substantially along a single expansion axis upon release of the at least one retainer.

3. The method of claim 2, wherein the package has an expansion along the single expansion axis that is at least 20 cm upon release of the at least one retainer.

4. The method of claim 2, wherein the package has an expansion along the single expansion axis that is at least 20% upon release of the at least one retainer.

5. The method of claim 2, wherein the package of compressed mineral wool insulation loose blowing wool fibres is supported on a pallet and in which the single expansion axis is along a substantially vertical axis.

6. The method of claim 1, wherein the package comprises a flexible plastics film enveloping the blowing wool fibers.

7. The method of claim 6, wherein the flexible plastics film enveloping the blowing wool fibres comprises (i) an upper portion covering an upper surface and at least an upper part of the lateral surfaces of the package; and (ii) a separable lower portion covering a lower surface and at least a lower part of the lateral surfaces of the package.

8. The method of claim 7, where the flexible plastics film enveloping the blowing wool fibres further comprises: (iii) a middle portion covering the lateral surfaces and partially overlapping a part of the upper portion and a part of the lower portion.

9. The method of claim 1, wherein the blowing wool fibres are glass wool fibres.

10. The method of claim 1, wherein the compressed bulk of blowing wool fibres has a density of at least 80 kg/m$^3$.

11. The method of claim 1, wherein the package of compressed mineral wool insulation loose blowing wool fibres has a mass of at least 80 kg.

12. The method of claim 1, wherein the package of compressed mineral wool insulation loose blowing wool fibres has a length of at least 0.9 m, a width of at least 0.75 m, and a height of at least 0.8 m.

13. The method of claim 1, wherein the package of compressed mineral wool insulation loose blowing wool fibres have lateral surfaces which are substantially planar.

14. The method of claim 1, wherein the mineral wool insulation blowing wool fibres do not comprise a binder.

15. A method of packaging compressed mineral wool insulation blowing wool fibres comprising sequentially:

compressing uncompressed mineral wool insulation blowing wool fibres with a press along a single axis to produce a compressed bulk of blowing wool fibres;

retaining the compressed bulk of blowing wool fibres with at least one retainer to form a package of compressed mineral wool insulation loose blowing wool fibres;

removing the at least one retainer from the package of compressed mineral wool insulation loose blowing wool fibres and removing any enveloping film covering an upper surface of the blowing wool package;

wherein upon release of the at least one retainer, the mineral wool insulation blowing wool fibres expand substantially along a single expansion axis; and wherein the mineral wool insulation blowing wool fibres are selected from loose blowing wool fibres, loose blowing wool flocks and combination thereof.

16. The method of claim 15, wherein the mineral wool insulation blowing wool fibres do not comprise a binder.

17. A method for manufacturing a package of compressed mineral wool insulation loose blowing wool fibres comprising sequentially:

compressing uncompressed mineral wool insulation blowing wool fibres with a press along a single axis to produce a compressed bulk of blowing wool fibres; and retaining the compressed bulk of blowing wool fibres with at least one retainer, wherein the mineral wool insulation blowing wool fibres are selected from loose blowing wool fibres, loose blowing wool flocks and combination thereof; and wherein the retainer comprises one or more securing straps arranged around the package; and wherein the package comprises a flexible plastics film enveloping the blowing wool fibers.

18. A method of packaging compressed mineral wool insulation blowing wool fibres comprising sequentially:

compressing uncompressed mineral wool insulation blowing wool fibres with a press along a single axis to produce a compressed bulk of blowing wool fibres;

retaining the compressed bulk of blowing wool fibres with at least one retainer to form a package of compressed mineral wool insulation loose blowing wool fibres;

wherein the retainer comprises one or more securing straps arranged around the package; and wherein the package comprises a flexible plastics film enveloping the blowing wool fibers;

removing the at least one retainer from the package of compressed mineral wool insulation loose blowing wool fibres and removing any enveloping film covering an upper surface of the blowing wool package;

wherein upon release of the at least one retainer, the mineral wool insulation blowing wool fibres expand substantially along a single expansion axis; and wherein the mineral wool insulation blowing wool fibres are selected from loose blowing wool fibres, loose blowing wool flocks and combination thereof.

* * * * *